US009604219B2

(12) United States Patent
Mortillaro et al.

(10) Patent No.: US 9,604,219 B2
(45) Date of Patent: Mar. 28, 2017

(54) THERMAL CYCLER WITH OPTIMIZED SAMPLE HOLDER GEOMETRY

(75) Inventors: Michael J. Mortillaro, Webster, NY (US); David A. Cohen, Dedham, MA (US)

(73) Assignee: Thermo Fisher Scientific Oy, Vantaa (FI)

( * ) Notice: Subject to any disclaimer, the term of this patent is extended or adjusted under 35 U.S.C. 154(b) by 918 days.

(21) Appl. No.: 12/065,874

(22) PCT Filed: Sep. 5, 2006

(86) PCT No.: PCT/FI2006/050378

§ 371 (c)(1),
(2), (4) Date: May 12, 2008

(87) PCT Pub. No.: WO2007/028860

PCT Pub. Date: Mar. 15, 2007

(65) Prior Publication Data

US 2008/0254517 A1 Oct. 16, 2008

Related U.S. Application Data

(60) Provisional application No. 60/714,903, filed on Sep. 6, 2005.

(30) Foreign Application Priority Data

Sep. 6, 2005 (FI) ..... 20050881

(51) Int. Cl.
*B01L 7/00* (2006.01)
*B01L 9/00* (2006.01)

(52) U.S. Cl.
CPC ..... *B01L 7/52* (2013.01); *B01L 9/523* (2013.01); *B01L 2200/02* (2013.01); *B01L 2300/0829* (2013.01); *B01L 2300/1805* (2013.01)

(58) Field of Classification Search
CPC ..... B01L 2200/02; B01L 2300/0829; B01L 2300/1805; B01L 7/52; B01L 9/523
(Continued)

(56) References Cited

U.S. PATENT DOCUMENTS 4,682,891 A * 7/1987 de Macario et al. ..... 356/244
5,456,360 A * 10/1995 Griffin ..... 206/443
(Continued)

FOREIGN PATENT DOCUMENTS

GB 2370112 A 6/2002
JP 2003-505663 A 2/2003
(Continued)

OTHER PUBLICATIONS

English translation of Office Action issued on Jun. 21, 2011 in corresponding Japanese patent application No. 2008-529652.
(Continued)

*Primary Examiner* — Gautam Prakash
(74) *Attorney, Agent, or Firm* — Wood Herron & Evans LLP

(57) ABSTRACT

The invention concerns a thermal cycler and a microtiter plate. The cycler comprises a sample holder having a first surface and a surface and means for automated, controlled heating and cooling of the sample holder. The first surface of the sample holder is designed to hold a plurality of samples arrayed in a grid having a predefined pitch. The number of samples in one dimension is an exact match of the SBS plate standards for that sample pitch and in another dimension corresponds to a fraction of the number of samples in a second dimension of an SBS microtiter standard plate. According to the invention, the sample holder is shaped such that the area of the second surface is larger than the area of the first surface. By means of the invention, the thermal ramping speeds of the cycler can be significantly increased.

11 Claims, 3 Drawing Sheets

(58) Field of Classification Search
USPC ... 435/6.1, 86.1, 287.1, 287.3, 288.4, 288.5, 435/303.1
See application file for complete search history.

(56) References Cited

U.S. PATENT DOCUMENTS

| | | | | |
|---|---|---|---|---|
| 5,459,300 | A * | 10/1995 | Kasman | 219/433 |
| 5,475,610 | A * | 12/1995 | Atwood et al. | 700/269 |
| 5,589,136 | A * | 12/1996 | Northrup et al. | 422/129 |
| 6,337,435 | B1 * | 1/2002 | Chu et al. | 136/242 |
| 6,514,750 | B2 * | 2/2003 | Bordenkircher et al. | B01L 7/52 422/50 |
| 6,558,631 | B1 * | 5/2003 | Day | 422/552 |
| 2002/0127660 | A1 * | 9/2002 | Danssaert et al. | 435/91.3 |
| 2003/0072685 | A1 * | 4/2003 | Goldman | B01L 3/50851 422/400 |
| 2004/0086927 | A1 * | 5/2004 | Atwood et al. | 435/6 |
| 2005/0265901 | A1 | 12/2005 | Sinclair et al. | |

FOREIGN PATENT DOCUMENTS

| | | | |
|---|---|---|---|
| WO | WO-01/08800 | A1 | 2/2001 |
| WO | WO-03/061832 | A1 | 7/2003 |
| WO | WO-2004/018105 | A1 | 3/2004 |
| WO | WO-2005/068066 | A1 | 7/2005 |

OTHER PUBLICATIONS

Stratagene, Instruction Manual for RoboCycler® Temperature Cyclers and Accessories, IN #70183-00, Revision #032002, 2002 (55 pages).

* cited by examiner

THERMAL CYCLER WITH OPTIMIZED SAMPLE HOLDER GEOMETRY

This Application is the National Phase Under 35 U.S.C. §371 of PCT International Application No. PCT/FI2006/050378 which has an International filing date of Sep. 5, 2006, which claims priority to Finish Application No. 20050881 filed on Sep. 6, 2005, and also on U.S. Provisional Application No. 60/714,903 filed on Sep. 6, 2005, the entire contents of all applications listed above are hereby incorporated by reference.

BACKGROUND OF THE INVENTION

Field of the Invention

The present invention relates to devices for processing biological samples, especially for amplifying DNA sequences by the Polymerase Chain Reaction (abbreviated "PCR") method. In particular, the invention concerns a thermal cycler comprising a sample holder portion as well as a microtiter plate designed to be placed in a holder of a cycler device.

Description of Related Art

Thermal cyclers are instruments commonly used in molecular biology for applications such as PCR and cycle sequencing, and a wide range of instruments are commercially available. A subset of these instruments, which include built-in capabilities for optical detection of the amplification of DNA, are referred to as "real-time" instruments. Although these can sometimes be used for different applications than non-real-time thermal cyclers, they operate under the same thermal and sample preparation parameters.

The important parameters that govern how well a thermal cycler operates are: uniformity, accuracy and repeatability of thermal control for all the samples processed, ability to operate in the environment of choice, speed of operation, and sample throughput.

The uniformity, accuracy and repeatability of thermal control is critical, because the better the cycler is in these parameters, the more confidence can be placed in the results of the tests run. There is no threshold beyond which further improvement in these parameters is irrelevant. Further improvement is always beneficial.

The ability to operate in the environment of choice is not a problem for devices used in a laboratory setting where the samples are brought to it, but choices become limited when it is desired to use the instruments outside the laboratory and to bring it to where the samples are located. The two main concerns here involve the size and, thus, portability of the instrument, and the power requirements of the instrument. These two concerns are directly related, as the biggest single component in most cyclers is the heat sink used to reject the waste heat generated by the cycling. If a thermal cycler were to be built such that it only required enough power to operate off an automobile battery, it would also use a smaller heatsink because less waste heat was being generated and it would become portable enough to operate virtually anywhere on earth.

Thermal cycling speed is important not just because it is a major factor in determining sample throughput, but also because the ability to amplify some products cleanly and precisely is enhanced or even enabled by faster thermal ramp rates. This can be particularly true during the annealing step that occurs on each cycle of an amplification protocol. During that time, primers are bonded onto the templates present, but if the temperature is not at the ideal temperature for this, non-specific bonding can occur which in turn can lead to noise in the results of the reaction. By increasing ramp rate, the time that the reaction spends at non-ideal temperatures is reduced.

Sample throughput needs have come about over time. All currently produced thermal cyclers can be divided up into groupings based on how they accommodate samples. The first instruments were built to accommodate a small number of tubes which were individually processed and loaded into the cycler (example: Perkin-Elmer 4800). As sample throughput needs grew, instruments were developed to accommodate plastic trays (microtiter plates) that were essentially arrays of 96 or 384 tubes (examples: Perkin-Elmer 9600, MJ Research PTC-200, Eppendorf MasterCycler). Both of these approaches utilized metal blocks to heat and cool the tubes, which places some limits on the speed of thermal cycling due to the time needed to heat and cool the mass of the metal. Another approach to increase sample throughput focused on decreasing the time needed to process a batch of samples by speeding up the rate of thermal transfer to the samples, and these systems utilized glass capillaries or proprietary sample holders (examples: Idaho Technologies RapidCycler, Cephied Smartcycler, Analytik Jena Speedcycler). The last category of thermal cycler instruments are built around microfluidics-based sample holders, but have not been widely used due to the limited fluid volume of the samples they can process and the difficulty of preparing the microfluidics sample holders.

The vast majority of thermal cyclers in use today are in the second grouping: block based thermal cyclers that accommodate microtiter plates. The reason for this, despite the lower cycling speed of these instruments, is that microtiter plates can be used with a wide range of liquid volumes, and the actual sample throughput is higher in terms of total number of samples that can be processed in a given timeframe. This last is only partially a function of the instrument itself; it is also due to the equipment that is available to process and load the samples. The vast majority of microtiter plates in use conform to a set of standards codified by the Society for Biomolecular Screening (SBS) over the last decade. The plates typically have 6, 24, 96, 384 or even 1536 sample wells arranged in a 2:3 rectangular matrix. The standard governs also well dimensions (e.g. diameter, spacing and depth) as well as plate properties (e.g. dimensions and rigidity).

A number of robots designed to specifically handle SBS microplates have been developed. These robots may be liquid handlers which aspirate or dispense liquid samples from and to these plates, or "plate movers" which transport them between instruments. Also plate readers have been developed, which can detect specific biological, chemical or physical events in samples being processed in the plates.

Adherence to the SBS Microtiter Plate Standards, has allowed for easy integration of robotics solutions, such as liquid handling machines, into the sample preparation process, which has had a profound impact on the ability to increase sample throughput.

It can therefore be concluded that technical solutions that will further increase sample throughput must do so without compromising the ability to work within the SBS specifications. Though having assisted with the spread of cycler instruments and harmonized the processes used by different device manufacturers, some specifications of SBS standards have also limited further development of cycler instruments by narrowing down the scope of research, for example, as far as power consumption and cycling rate are concerned.

In a set of laboratory protocol steps, in which PCR is one of those steps, PCR is often the rate limiting step. Thus, a primary objective of those familiar with the process is to decrease the overall time required to perform PCR.

Some known thermal cyclers having traditional heat transfer components are presented in the WO-publications 03/061832 and 2004/018105 and in the GB-publication 2370112.

SUMMARY OF THE INVENTION

It is an aim of the present invention to provide a thermal cycler device of a novel kind.

In particular, it is an aim of the invention to provide a SBS plate-standard compatible thermal cycler with improved speed, thermal uniformity and reduced power consumption. Especially, an aim of the invention is to provide a novel sample holder for a cycler device, which overcomes problems related to rapid heating and cooling and power consumption of prior art devices manufactured according to established practice.

It is another aim of the invention to provide a novel use for a microtiter plate and a novel sample holder.

These and other objects, together with the advantages thereof over known methods and apparatuses, are achieved by the present invention, as hereinafter described and claimed.

The invention is based on the idea of increasing the heat transfer area of the sample holder relative to the sample-receiving area of the sample holder while maintaining compatibility with the majority of existing SBS microtiter automatics and without compromising thermal uniformity.

The genesis of this invention came about when it was realized that although the SBS standards detail a two dimensional array for microtiter plates, the majority of liquid handling robots which are so important to the increased throughput of thermal cycling load the samples in a one-dimensional manner that is then repeated for as many times as is necessary to load in the second dimension. This means that it is possible to maintain the advantages of using the SBS standards while modifying the sample block such that other properties are maximized in ways that had previously only been achieved by those who abandoned the standard entirely.

According to an embodiment, a thermal cycler according to the present invention comprises a sample holder having an upper and a lower side, with a first surface on the upper side thereof, and a second surface on the lower side. The first surface exhibits a rectangular grid of sample-receiving wells and the second surface of the sample holder, in the following also denoted "the heat transfer surface", has an area, which is considerably larger than the area of the first surface. The first surface is shaped such that the number of wells in one dimension of the holder corresponds to the specification of a first dimension of a SBS microtiter standard plate for a given sample pitch and in a second dimension corresponds to a certain fraction of the specification for a second dimension of the SBS microtiter standard plate. In addition, the cycler comprises means for automated and controlled heating and cooling of the sample holder.

The microtiter plate according to the invention comprises a plurality of sample wells arranged in a grid, the plate having a first dimension that matches the first dimension of an SBS microtiter standard plate and a second dimension that corresponds to a fraction of a second dimension of the SBS microtiter standard plate.

More specifically, the thermal cycler is characterized by comprising

- a sample holder having a first upper surface and a second lower, heat transfer surface, said first surface exhibiting a sample-receiving surface formed to hold a plurality of samples arrayed in a grid having a predefined pitch, and
- means for automated, controlled heating and cooling of the sample holder, said means comprising a heat pumping component thermally coupled to the heat transfer surface of the sample holder, wherein

- the sample holder is shaped such that the area of the heat transfer surface is larger than the area of the sample-receiving surface, characterized in that

- the number of samples in one dimension of the sample holder is an exact match of the SBS plate standards for that sample pitch and in another dimension corresponds to a fraction of the number of samples in a second dimension of a SBS microtiter standard plate, and
- the heat pumping component has an area comparable to that of the heat transfer surface of the sample holder for achieving focused heating or cooling of the samples.

The use is characterized by a method for thermal cycling a sample which comprises using a microtiter plate comprising a plurality of individual sample wells arranged in a grid, the dimension of the plate in a first dimension corresponding to a first dimension of an SBS microtiter standard plate and in a second dimension corresponding to a fraction of a second dimension of the SBS microliter standard plate in a thermal cycler.

The sample holder is characterized by the number of samples in one dimension of the sample holder being an exact match of the SBS plate standards for that sample pitch and in another dimension corresponds to a fraction of the number of samples in a second dimension of a SBS microtiter standard plate and the sample holder being shaped such that the area of the heat transfer surface is larger than the area of the sample-receiving surface.

Considerable advantages are obtained by means of the invention. We have found that by increasing the ratio of the areas of the heat transfer surface and the sample-receiving surface of the sample holder it is possible to considerably influence the temperature ramping speed. This opens up possibilities for advantageous cycler solutions without having to dramatically change other established procedures and practices related to cyclers.

A major benefit accrued by use of this reduced-volume sample holder is its ability to take advantage of the ratio of surface area of the heat flux controlling elements to the footprint of the sample holders. Thus, a considerable heat-focusing effect is achieved. The cycler according to the invention resembles conventional block-based thermal cyclers, but with the modification that the sample-receiving surface of the typically metallic sample holder is made smaller such that it can accommodate a small sample plate which conforms to the SBS standard in one dimension, thus allowing full use of liquid handling robots. Further, the design of the instrument does not prevent the small plate from being constructed such that multiple small plates can be assembled into a form that conforms entirely to the SBS microtiter plate standard. The second dimension of the plate can be a submultiple of the corresponding dimension of a SBS microtiter plate standard, for example, ½, $\frac{1}{3}^{rd}$, $\frac{1}{4}^{th}$ or $\frac{1}{6}^{th}$ the size of such a plate, and it can constructed such that it conforms with the SBS standard 9 mm, 4.5 mm or 2.25 mm well pitch. In the case of a small sample plate which is $\frac{1}{4}^{th}$ the size of a microtiter plate, a special benefit is realized as standard laboratory equipment designed to handle microscope slides can also be utilized for handling of this small sample plate.

A sample holder according to the embodiments described in this document enables

- higher temperature ramping speeds due to the higher ratio of power to sample holder thermal capacity,
- better thermal uniformity due to the reduced distance between the most distantly located samples,
- a shorter time required for all samples to settle to target temperature due to the reduced distance between the most distantly located samples, and
- lower power consumption is possible due to the lower mass of the sample holder.

Thus, the sample holder described in this document can be used in reduced size, possibly portable cycler devices or instrumentation stations that are incorporated in vehicles or other host units. The power source or the host unit can be utilized for providing the required working power to the cycler due to small power requirements achieved by improved power focusing on the samples. High temperature ramping speeds, and thus shorter PCR processes, for example, achieved also support the use of the invention in field applications, where quick results are desired. For the same reasons, also the efficiency of laboratory devices can be improved and processing times decreased.

The cycler and plate according to the invention can be conveniently incorporated into larger analysis entities such that the size and the power consumption of the device are not increased unreasonably much. Thus, a potential application area of the cycler and microtiter plates according to the invention lies in real-time quantitative PCR. A particularly advantageous application area lies in portable processing stations, which are operated by stand-alone power sources, such as batteries or other indirect forms of electrical energy (non-network electricity).

Furthermore, the improved thermal uniformity enables the use of the invention in processes requiring high sample-to-sample precision, as it leads to more consistent reactions as measured amongst different wells in the same instrument.

An additional benefit accrues if the thermal cycler is monitored by an optical detection system as is commonly done in real-time PCR. In that case, the smaller sample holder size allows more compact optical design to be used due to the reduced area that must be focused upon. Thus, the focal path lengths can be reduced in order to make the overall size of the device small enough to be readily portable.

The areas of the sample-receiving surface (also called "sample-receiving zone") and the heat transfer surface for the purpose of this description as simply the length times the width of the planar region of the surface, without regard to any features that may be present on the surfaces. In other words, by the area of the first and second surfaces of the sample holder we mean the area of the projection of the surfaces in a direction normal to the general plane of the sample holder.

Next, the invention will be described more closely with reference to the attached drawings, which represent an exemplary embodiment of the invention.

DETAILED DESCRIPTION OF THE INVENTION

Many different configurations are possible within the scope of this invention, including variations on part geometries, methods of assemblies and configurations of parts relative to each other. The description here is meant to illustrate and represent one possible embodiment of the invention.

Figure 1:
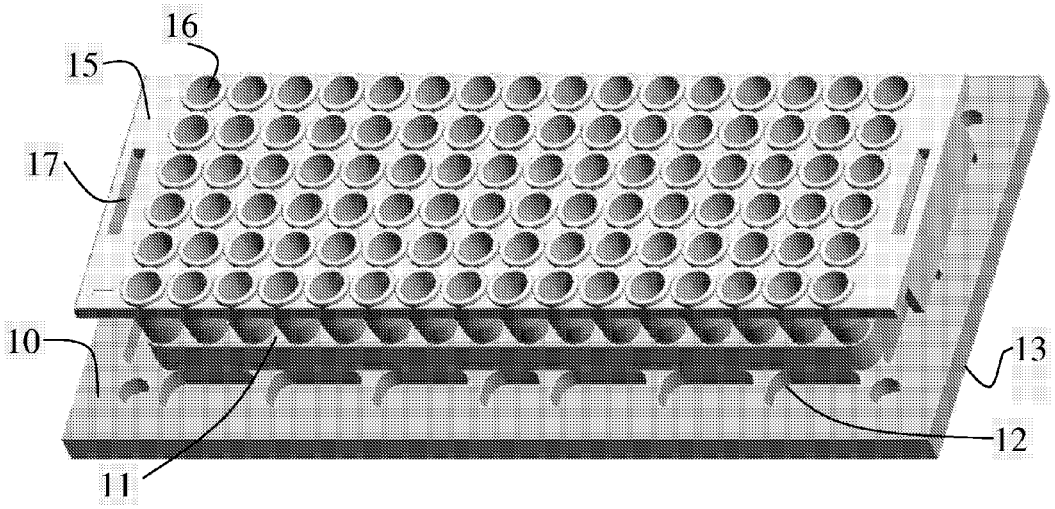
FIG. 1 shows a perspective view of an embodiment of a microtiter plate and a sample holder according to the invention.

FIG. 1 shows a first embodiment of the present reduced sized sample holder. The sample holder has a sample-receiving (first) surface 11 (shown in FIG. 1) that contains recesses shaped to accept sample tubes 16 (bottom portions) of a plastic plate 15 that holds biological samples, and a heat transfer (second) surface 13 (hidden in FIG. 1) opposite the first surface.

The narrowing of the sample holder can be stepwise, as shown in FIG. 1 or can have another form, such as a continuously tapering shape towards the first surface 11. Additional structures, such as cavities 12 may be provided on either side 10, 13 of the sample holder for assisting more uniform heating of the wells, for reducing the mass of the sample holder or, for example, mechanical alignment of the sample holder into the cycler device. According to a further embodiment, there is also provided thermal insulators on the top surface 10 of the wide part of the sample holder for even more efficient focusing of heat to or removal of heat from the samples.

Figure 3:
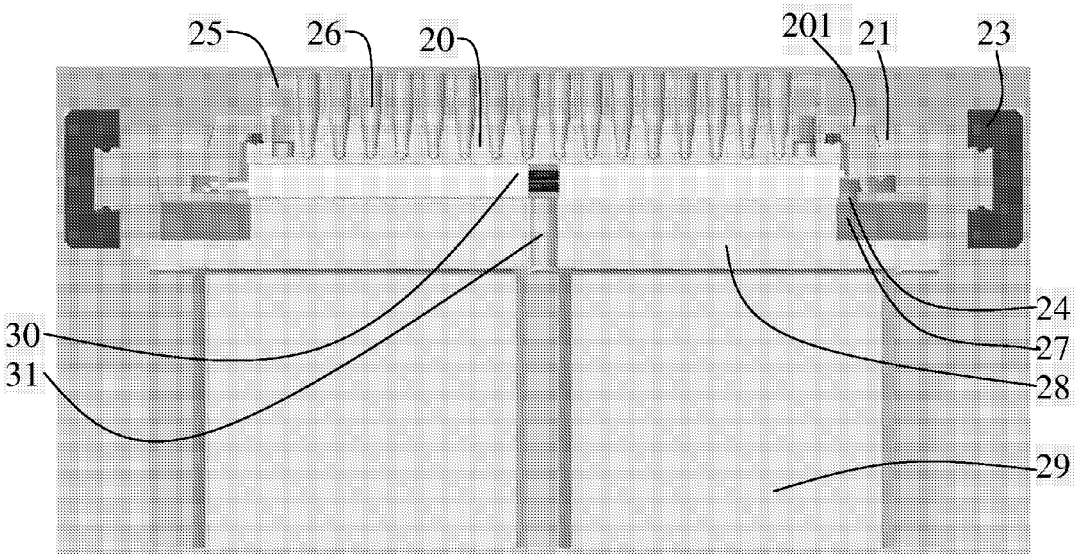
FIG. 3 illustrates a cross section of an arrangement of FIG. 2 with two peltier elements sandwiched between a sample holder and a heat sink shown.

The second surface 13 of the sample holder is preferably in thermal contact with at least one device that can add heat to the sample holder (heater device) and at least one device that can remove heat from the sample holder (cooler device). These devices can be one unitary device that allows both operations, such as a peltier module, which is shown in FIG. 3 and denoted with the reference numeral 30.

The sample holder 10 is preferably made of metal. It can be machined out of a solid block of aluminum or silver, or it can be molded, stamped, cast or assembled from more than one component. In general, the sample holder preferably has a low mass, such that the heat reservoir formed by it remains small and higher temperature ramping speeds can be achieved.

A key feature that distinguishes the sample holder of the invention from other sample holders is the size and format. In a preferred embodiment of the invention, the sample holder is rectilinear in format and holds an even fraction of the sample tubes (wells) contained in a standard microtiter plate, including all the tubes in a first dimension (horizontally aligned in FIGS. 1-4) but only $\frac{1}{4}^{th}$ the tubes in a second dimension (perpendicular to the first dimension, in the plane of the top surface of the holder). It can however hold sample tubes that are of standard wall thickness or tubes that have thinner wall dimensions to aid in faster heat transfer. It can also accommodate tubes that are of the same height as the sample holder or tubes that are considerably higher than the height of the sample holder, thus allowing for operations that require higher sample volumes, such as post-cycling washes, to be accomplished in the same tubes that are used for thermal cycling.

The size of the first surface of the sample holder in a preferred embodiment of the invention is between 70 and 100 mm in a first dimension and between 25 and 45 mm in a second dimension. The exact dimensions of the sample holder vary depending on the sample pitch for which the sample holder is optimized, whether that pitch is 9 mm, 4.5 mm or 2.25 mm. The dimensions also depend on the size of the devices used to add and remove heat from the sample holder, as the dimensions of the second surface of the sample holder must be designed to correspond to those.

According to a preferred embodiment, the dimensions of the first and second surfaces of the sample holder are different by means of a broadening, typically a flange or rib, that protrudes around the sample holder such that it effectively increases the size of the second surface without increasing the size of the top surface of the sample holder. This feature is clearly shown in the drawings, and is important because it allows for larger, more powerful peltier or other heat pumping components to be used with a sample holder designed for use of a particular configuration of plate, thus increasing the total thermal ramping rate by increasing the ratio of power to sample holder mass. The flange or rib can extend sideways from each side of the sample holder, but because of compatibility issues, it typically extends more in the direction of the reduced, second dimension of the sample holder, preferably symmetrically.

Peltier modules, like many other heat pumping components, are limited in power capacity which is directly proportional to the surface area that they contact. Thus, a speed advantage can be realized by increasing the surface area of the bottom of the sample holder relative to the area described by the footprint of the samples themselves. There is however a limit to how much the bottom surface area can be increased before thermal non-uniformity and other negative effects overcome the speed benefits. For a typical thermal cycler designed to accommodate microtiter plates, this limit is reached when the bottom surface is at slightly more than 100 $cm^2$, which corresponds to a ratio of heat-generating area to sample tube footprint of less than 1.19. By reducing one dimension of the sample holder as was done with preferred embodiment of the invention, a ratio of greater than 1.41 was achieved. If all other factors are held equal, this factor alone results in a 20% increase of thermal ramp rate. It would be feasible to increase this ratio even further by further reducing the footprint of the sample plate, the ratio limit being reached at around 9.0 for a sample plate that contains only a single line of samples equal in length to the short dimension of an SBS compliant plate, and at 40.0 for a sample holder that only accommodates a single sample. However, when going to the very extremes, other factors would come into play that prevents the system from benefiting in terms of speed to anywhere near the degree that this high ratio would suggest.

As is clearly seen from the exemplary calculations above, the benefits of using a narrowing sample holder are lost to a high extent if standard-sized sample holders are used. Moreover, by increasing the area of the second surface area of a sample holder having a standard-sized first surface, the compatibility of the sample holder with existing cyclers would be lost. Hence, a combination of reduced sized sample-receiving area and appropriately adjusted heat transfer area provide maximum benefits, as far as compatibility and ramping speeds are concerned.

Although peltier modules provide a convenient way of heating and cooling the samples, also other method of heat transfer can be used. These include, for example, hot/cool air convection by using fans, liquid heater/coolant-based systems and mechanical contacting of the sample holder with hot/cool reservoirs. In all methods, the ratio of the heat transfer area to sample area is an important factor.

According to one embodiment the thermal cycler comprises a sample holder formed to hold a plurality of samples arrayed in a 9 mm, 4.5 mm or 2.25 mm grid, the number of wells in one dimension being an exact match of the SBS plate standards for that sample pitch. In a second direction perpendicular to the first direction, the dimension of the sample-receiving surface of the holder is a fraction of the corresponding dimension of an SBS holder for that sample pitch.

According to one embodiment, the ratio of the areas of the heat transfer surface and the sample-receiving surface of the sample holder is equal to or less than the inverse of the fraction defining the second dimension of the sample-receiving surface. Typically, the most efficient ratio settles between 1.2 and 9, usually between 1.2 and 4, in particular 1.2 and 2, depending, for example, on the size of the sample-receiving surface, method of heat production and removal, thicknesses of the flange and the sample-receiving parts of the sample holder, cycler design and uniformity requirements. The ratio of the areas of the heat pumping component and the heat transfer surface of the sample holder can be 0.8-1.2. In particular, it has to be noted, that as the area of the heat transfer surface is increased, also the total mass of the sample holder increases (though not as much as if the whole sample holder was increased). This raises the thermal capacity of the sample holder. The average thickness of the flange part with respect to the total thickness of the sample holder is preferably about 10-70%, typically about 20-50%. Within these ranges the ratio of the heat focusing ability and the heat capacity of the sample holder is maximized in typical applications.

The sample holder is preferably made of low-mass metal, such as aluminum or silver, or an alloy of metals. Alternatively, the holder can be composed of some ceramic material. Typically the sample holder consists of a single element but it can also be manufactured from several parts layered on top of each other, for example. General requirements for the sample holder are good thermal conductivity, low heat capacity and mechanical strength.

The microtiter plate is preferably made of polypropylene or some other PCR-compatible material known per se. The plate is typically non-coated but can also have a top coating comprising, for example, $SiO_2$, polyaniline or antibodies, depending on the application.

Figure 2:
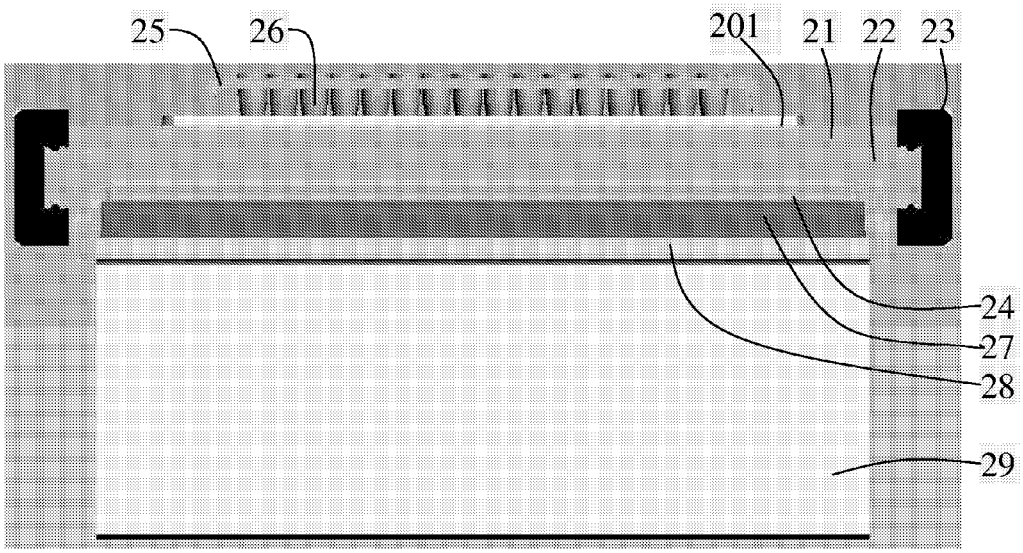
FIG. 2 depicts a side view of a cycler according to an embodiment of the invention.
Figure 4:
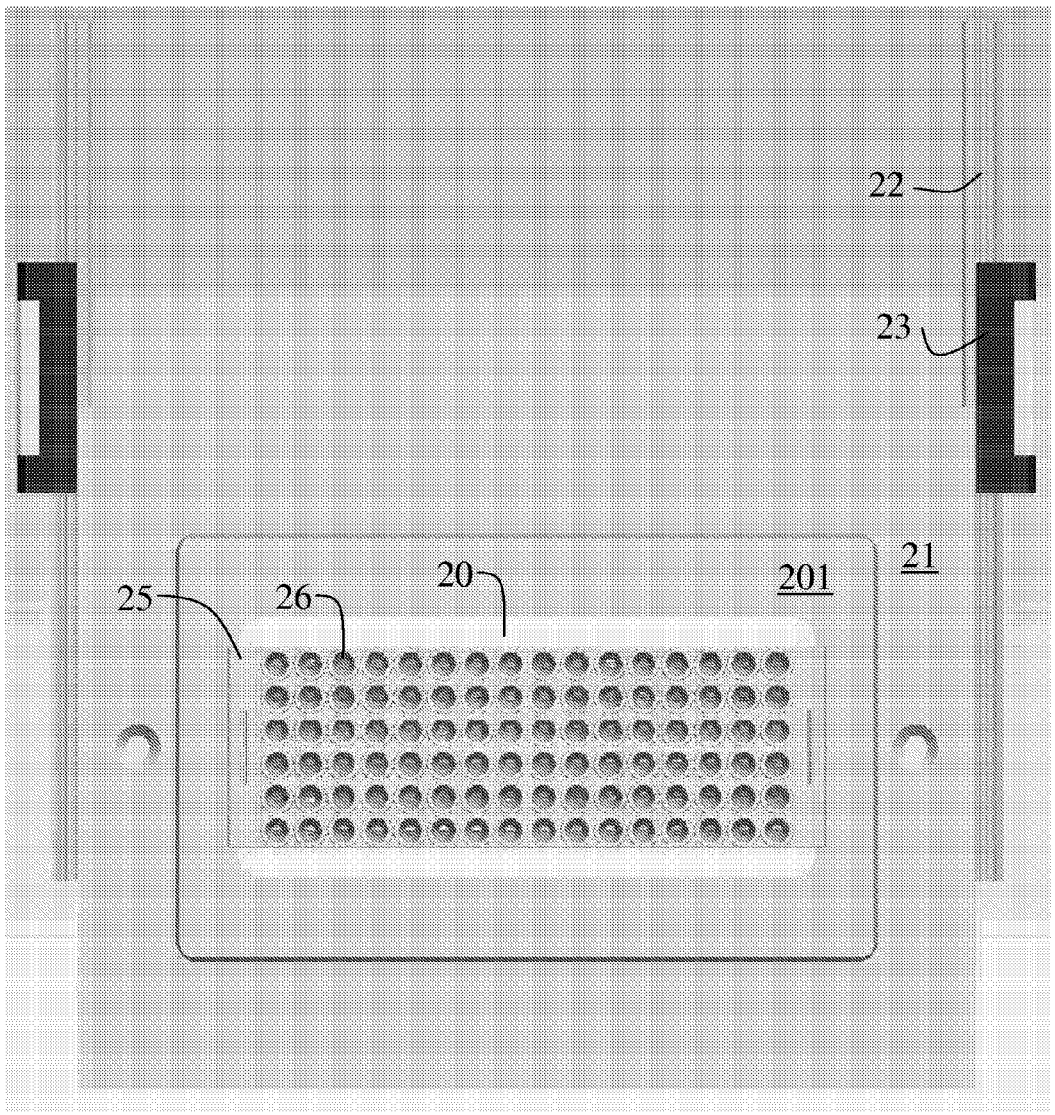
FIG. 4 shows a top view of a microtiter plate in sample holder.

FIGS. 2-4 show a sample holder and a microtiter plate assembled into an exemplary cycler device. FIGS. 2 and 3 represent side views of the cycler in two different sections. FIG. 4 is a corresponding top view. The microplate is denoted with a reference numeral 25. Sample tubes 26 are denoted with a reference numeral 26. The sample holder 20 is placed in such a position, that the tube wells open upwards for receiving the microplate 25. Below the sample holder 20, there are two peltier elements 30, which are connected to a heat sink 28 with cooling fins 29 for efficient temperature control. The sample holder 20 is placed on a retaining structure 201 to which are attached a stiffening plate 21, a circuit board 24 and rails 22. The rails 22 enable movement of the sample holder 20 and the microplate 25 in the second direction through slides 23 which are mounted to the instrument box (not shown). The entire assembly is held together by means of mechanical fasteners (not shown) which bolt the heatsink 28 to the sample holder 20 and the heatsink to the stiffening plate 21. These fasteners pass through spaces 31 provided in the heatsink structure. Also present are several gaskets such as 27 which prevent foreign material from entering into the central cavity occupied by the peltier modules 30.

Means for adding and removing heat from the sample are typically mechanically coupled to the second surface of the sample holder. In a preferred embodiment of the invention, heat is added and removed by means of one or more peltier elements that are pressed into close thermal contact between the bottom surface of the sample holder and a heatsink which is used to reject waste heat. Thermal interface materials can be used between the sample holder and the peltier elements, and between the peltier elements and the heatsink to provide better thermal contact between elements. One or more temperature sensors may be provided for monitoring the temperature of the sample holder, and a computer controls modulation of power to the peltier elements such that precise temperature control is achieved. A sensor measures the temperature of the heatsink, and the computer modulates the speed of a fan which conducts air through the fins of the heatsink to control the rate of rejection of waste heat from the heatsink.

Several sample holders and plates described above can be used in parallel to form a bigger unit having, for example, dimensions of a standard SBS unit by using an appropriate cycler machine. By providing separate heating and cooling equipment for each of the holders, the temperature of each of the plates on the holders can be independently adjusted. However, the compatibility with the sample and plate handling robotics and analysis equipment would still be fully maintained.

Typically in practice, power and control means in the form of electronic elements are provided for performing the essential functions of the PCR process. Software elements can be used to provide automated monitoring and a user interface element to the process. In addition, mechanical elements are provided to ensure that the tubes are seated tightly into the sample holder, to assist in easy access to the samples and to secure and hold in place and contain all the components of the equipment. All of these elements can be easily designed by one skilled in the art.

Because of the heat-focusing effect of the present device, smaller output power sources can be used, while maintaining the thermal performance advantages. In conventional devices, reducing the output of the power source has always been done at the expense of ramping speeds or other performance characteristics.

According to an embodiment, the cycler receives its operating power from a non-network power source, such as a battery or generator of its own or of a host device the cycler is used with. Thus, the cycler preferably comprises a connector (e.g., a plug, socket) for supplying electric power from the power source. The host device can comprise, for example, a vehicle which is used for transporting the cycler. Low power consumption achieved by means of the embodiments described in this document enable even battery-driven operation of the cycler with an operating time of hours, even days.

The invention claimed is:

1. A thermal cycler designed to subject a plurality of samples to a temperature cycling regime, said cycler comprising:

a sample holder having a first upper surface and a second lower heat transfer surface defined by a flange protruding outwardly from the sample holder, the flange having at least one cavity formed in an upper surface thereof, said first upper surface exhibiting a planar sample-receiving surface comprising a plurality of sample recesses arrayed in a grid and formed in the sample-receiving surface so as to extend below the sample receiving surface, with the sample receiving surface and the sample holder being continuous between the plurality of sample recesses, the grid of sample recesses having a pitch of 9 mm, 4.5 mm or 2.25 mm for holding a plurality of samples, the number of sample recesses in a first dimension of the sample holder being 8 for 9 mm pitch, 16 for 4.5 mm pitch and 32 for 2.25 mm pitch, and the number of sample recesses in a second dimension perpendicular to said first dimension of the sample holder corresponding to a submultiple of 12 for 9 mm pitch, 24 for 4.5 mm pitch and 48 for 2.25 mm pitch so as to define a fraction, at least one device to automatically control heating and cooling of the sample holder, said device being thermally coupled to the heat transfer surface of the sample holder, and a heat sink having an upper heat transfer surface, said heat sink heat transfer surface being thermally coupled to the device, wherein the sample holder is shaped such that the area of the heat transfer surface is larger than the area of the sample-receiving surface.

2. A thermal cycler designed to subject a plurality of samples to a temperature cycling regime, said cycler comprising a sample holder having a first upper surface and a second lower heat transfer surface defined by a flange protruding outwardly from the sample holder, the flange having at least one cavity formed in an upper surface thereof, said first upper surface exhibiting a planar sample-receiving surface comprising a plurality of sample recesses arrayed in a grid and formed in the sample-receiving surface so as to extend below the sample receiving surface, with the sample receiving surface and the sample holder being continuous between the plurality of sample recesses, the grid of sample recesses having a pitch of 9 mm, 4.5 mm or 2.25 mm for holding a plurality of samples, the number of sample recesses in a first dimension of the sample holder being 8 for 9 mm pitch, 16 for 4.5 mm pitch and 32 for 2.25 mm pitch, and the number of sample recesses in a second dimension perpendicular to said first dimension of the sample holder corresponding to a submultiple of 12 for 9 mm pitch, 24 for 4.5 mm pitch and 48 for 2.25 mm pitch so as to define a fraction, at least one device to automatically control heating and cooling of the sample holder, said device comprising a pettier module thermally coupled to the heat transfer surface of the sample holder, and a heat sink having an upper heat transfer surface, said heat sink transfer surface being thermally coupled to the peltier module, wherein the sample holder is shaped such that the area of the heat transfer surface is larger than the area of the sample-receiving surface, and further wherein the ratio of the areas of the peltier module and the heat transfer surface of the sample holder is 0.8-1.2 and the ratio of the areas of the heat transfer surface of the heat sink and the heat transfer surface of the sample holder is 0.8-1.2 for achieving focused heating or cooling of the samples.

3. A thermal cycler according to claim 2, wherein the ratio of the areas of the heat transfer surface and the sample-receiving surface of the sample holder is equal to or less than the inverse of said fraction.

4. The thermal cycler according to claim 2, wherein the ratio of the areas of the heat transfer surface and the sample-receiving surface of the sample holder is 1.2-9.

5. The thermal cycler according to claim 4, wherein said ratio of the areas of the heat transfer surface and the sample-receiving surface is 1.2-4.

6. The thermal cycler according to claim 4, wherein said ratio of the areas of the heat transfer surface and the sample-receiving surface is 1.2-2.

7. The thermal cycler according to claim 2, further comprising a connector for supplying electrical power to the cycler from a stand-alone power source.

8. The thermal cycler according to claim 7, wherein said fraction is ½, $1/3^{rd}$, $1/4^{th}$ or $1/6^{th}$.

9. The thermal cycler according to claim 7, further comprising a power source, wherein said power source is a battery or a host unit.

10. A method for thermal cycling a sample which comprises subjecting a sample to thermal cycling processes in a thermal cycler according to claim 2, the sample being held in a microtiter plate comprising a plurality of individual sample wells arranged in a grid having a pitch of 9 mm, 4.5 mm or 2.25 mm for holding a plurality of samples, the number of sample wells in a first dimension of the microtiter plate being 8 for 9 mm pitch, 16 for 4.5 mm pitch and 32 for 2.25 mm pitch, and the number of sample wells in a second dimension perpendicular to said first dimension of the microtiter plate corresponding to a submultiple of 12 for 9 mm pitch, 24 for 4.5 mm pitch and 48 for 2.25 mm pitch so as to define a fraction.

11. The method according to claim 10, wherein said fraction is ½, $1/3^{rd}$, $1/4^{th}$ or $1/6^{th}$.

* * * * *